US010294554B2

(12) United States Patent
Kaneko

(10) Patent No.: US 10,294,554 B2
(45) Date of Patent: May 21, 2019

(54) COPPER ALLOY SHEET MATERIAL, CONNECTOR, AND METHOD OF PRODUCING A COPPER ALLOY SHEET MATERIAL

(71) Applicant: FURUKAWA ELECTRIC CO., LTD., Tokyo (JP)

(72) Inventor: Hiroshi Kaneko, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 421 days.

(21) Appl. No.: 15/192,083

(22) Filed: Jun. 24, 2016

(65) Prior Publication Data

US 2016/0305001 A1 Oct. 20, 2016

Related U.S. Application Data

(63) Continuation of application No. PCT/JP2014/084431, filed on Dec. 25, 2014.

(30) Foreign Application Priority Data

Dec. 27, 2013 (JP) ..... 2013-273520

(51) Int. Cl.

| | |
|---|---|
| ***C22F 1/08*** | (2006.01) |
| ***C22C 9/06*** | (2006.01) |
| ***H01B 1/02*** | (2006.01) |
| ***B22D 21/00*** | (2006.01) |
| ***C22C 1/02*** | (2006.01) |
| ***H01R 13/03*** | (2006.01) |

(52) U.S. Cl.

CPC ..... *C22F 1/08* (2013.01); *B22D 21/005* (2013.01); *C22C 1/02* (2013.01); *C22C 9/06* (2013.01); *H01B 1/026* (2013.01); *H01R 13/03* (2013.01)

(58) Field of Classification Search

CPC ..... C22F 1/08

See application file for complete search history.

(56) References Cited

U.S. PATENT DOCUMENTS

| | | | |
|---|---|---|---|
| 5,028,282 | A | 7/1991 | Kubozono et al. |
| 2010/0170595 | A1 | 7/2010 | Kaneko et al. |
| 2012/0148439 | A1 | 6/2012 | Shishido et al. |
| 2012/0241056 | A1 | 9/2012 | Sato et al. |

FOREIGN PATENT DOCUMENTS

| | | | |
|---|---|---|---|
| CN | 101680056 | A | 3/2010 |
| CN | 102639732 | A | 8/2012 |
| EP | 2508632 | A1 | 10/2012 |
| EP | 2706125 | A1 | 3/2014 |
| JP | 63-312937 | A | 12/1988 |
| JP | 2002-294367 | A | 10/2002 |
| JP | 2006-9108 | A | 1/2006 |
| JP | 2006-152392 | A | 6/2006 |
| JP | 2008-13836 | A | 1/2008 |
| JP | 2011-132594 | A | 7/2011 |
| JP | 2012-122114 | A | 6/2012 |
| JP | 2012-177153 | A | 9/2012 |
| JP | 2013-163853 | A | 8/2013 |
| WO | WO 2011/068134 | A1 | 6/2011 |
| WO | WO 2012/150702 | A1 | 11/2012 |

OTHER PUBLICATIONS

International Search Report for PCT/JP2014/084431 (PCT/ISA/210) dated Apr. 7, 2015.

Written Opinion of the International Searching Authority for PCT/JP2014/084431 (PCT/ISA/237) dated Apr. 7, 2015.

Chinese Office Action and Search Report, dated Jun. 15, 2017, for Chinese Application No. 201480068521.9, along with an English translation.

*Primary Examiner* — Jessee R Roe

*Assistant Examiner* — Jophy S. Koshy

(74) *Attorney, Agent, or Firm* — Birch, Stewart, Kolasch & Birch, LLP

(57) ABSTRACT

A copper alloy sheet material, having an alloy composition containing at least one of Ni and Co in an amount of 1.80 to 8.00 mass % in total, Si in an amount of 0.40 to 2.00 mass %, and at least one element selected from the group consisting of Sn, Zn, Ag, Mn, P, Mg, Cr, Zr, Fe, and Ti in an amount of 0.000 to 2.000 mass % in total, with the balance being copper and unavoidable impurities, wherein the major axis of the grains in the matrix is 12 μm or less; and wherein the orientation density of the {110}<001> orientation is 4 or more, and the orientation density of the {110}<112> orientation is 10 or more; a connector using thereof; and a method of producing the copper alloy sheet material.

4 Claims, 2 Drawing Sheets

COPPER ALLOY SHEET MATERIAL, CONNECTOR, AND METHOD OF PRODUCING A COPPER ALLOY SHEET MATERIAL

CROSS-REFERENCE TO RELATED APPLICATIONS

This application is a Continuation of PCT International Application No. PCT/JP2014/084431 filed on Dec. 25, 2014, which claims priority under 35 U.S.C. § 119 (a) to Japanese Patent Application No. 2013-273520 filed in Japan on Dec. 27, 2013. Each of the above applications is hereby expressly incorporated by reference, in its entirety, into the present application.

TECHNICAL FIELD

The present invention relates to a copper alloy sheet material and a connector using thereof, and a method of producing the copper alloy sheet material.

BACKGROUND ART

Along with making size of electric or electronic equipment smaller in recent years, making size of terminals and contact components smaller is underway. For example, in regard to an electrical contact, when the size of a member that constitutes a spring becomes small, the length of the spring is shortened, and thereby, the load stress applied to the copper alloy for spring is increased. When that stress becomes higher than the yield point of the copper alloy material, the material is permanently deformed, and the desired contact pressure as a spring may not be obtained. In that case, the contact resistance is increased, and the electrical connection becomes insufficient, which becomes a serious problem. Therefore, a copper alloy is required to have high strength.

An important characteristic besides strength is Young's modulus. In regard to Young's modulus, there are the cases where high Young's modulus is preferred, and there are the cases where low Young's modulus is preferred, depending on the design contents of terminals. That is, when Young's modulus is high, it is advantageous that high contact pressure is obtained with small displacements. Alternatively, when Young's modulus is low, it is advantageous that the extent that the material can undergo elastic deformation becomes large, the spring can be designed to have a wide range of displacement, and therefore, the dimensional tolerance can be extended. Since Young's modulus changes when the alloying elements contained or the alloy composition is changed, conventionally, a Cu—Sn-based alloy (bronze-based alloy) or the like has been used in the case where a material with low Young's modulus is intended to be used, or separately, a Cu—Ni-based alloy (cupronickel-based alloy) or the like has been used in the case where a material with high Young's modulus is intended to be used. In those cases, the number of kinds of the materials to be used is increased, depending on Young's modulus, and depending on the strength zone. Therefore, in the case where various copper alloy-pressed wastes are collected and recycled, there is a problem that recyclability is poor.

Further, when each of individual terminals becomes small-sized, there is a problem that the cross-sectional area through which electricity flows is decreased, and a desired current cannot be passed through. For example, a copper alloy that is commonly used as a terminal material is phosphor bronze. However, when the copper alloy has an alloying composition for high strength, the electrical conductivity is around 10% IACS, and this is insufficient for small-sized terminals. Further, when an electronic instrument becomes small-sized, the thermal capacity is reduced, and when the amount of Joule heating of a conductor is high, this is directly related to the overall temperature elevation of the instrument, which is a problem. Therefore, a copper alloy is required to have satisfactory electrical conductivity.

However, the high strength (for example, high yield strength) and the satisfactory electrical conductivity described above are contradictory characteristics in a copper alloy. In this regard, attempts have been, hitherto, made to achieve high strength and satisfactory electrical conductivity in various copper alloys.

Patent Literature 1 proposes that a copper alloy having high strength and satisfactory fatigue characteristics is obtained, by selecting an alloying composition containing the alloying components of a Cu—Ni—Sn-based alloy, and subjecting the alloy to age-precipitation hardening via a particular process.

Patent Literature 2 proposes that a copper alloy having high strength is obtained, by regulating the grain diameter of a Cu—Sn-based alloy and the finish-rolling conditions.

Patent Literature 3 proposes that in the case where the Ni concentration in a Cu—Ni—Si-based alloy is high, the alloy is made to having high strength by preparing the alloy via a particular process.

Patent Literature 4 proposes that a copper alloy having high strength is obtained, by selecting an alloying composition containing the alloying components of a Cu—Ti-based alloy, and subjecting the alloy to age-precipitation hardening via a particular process.

Patent Literature 5 proposes that by obtaining a Cu—(Ni, Co)—Si-based alloy sheet material via a particular production process, the area ratio of the (100) plane facing the RD is increased, the area ratio of the (111) plane facing the RD is decreased, and thereby an alloy is obtained, which has a low Young's modulus of 110 GPa or less in the rolled direction (RD).

Patent Literature 6 proposes that by obtaining a Cu—Ni—Si-based alloy strip via a particular production process, integration to the (220) plane is increased, thus I(220) has a high predetermined X-ray diffraction intensity and a particle size having a predetermined relationship between the transverse (sheet width) direction and the sheet thickness direction, and bending workability is enhanced, which is in the Good Way bending in which the bending axis is perpendicular to the rolled direction.

Patent Literature 7 proposes that by obtaining a Cu—Ni—Si-based alloy strip via a particular production process, a predetermined {110}<001> orientation density and a predetermined Kernel average misorientation (KAM) value are obtained, and the deep-drawing workability and the fatigue resistance characteristics are enhanced.

Patent Literature 8 proposes that by obtaining a Cu—Ni—Si-based alloy sheet via a particular production process, the texture state is controlled to the crystal orientation that is intermediate between the {110}<112> orientation and the {100}<001> orientation, a predetermined X-ray diffraction intensity with high I(220) and low I(200) is obtained, and the anisotropy in the RD (LD) and the TD of bending workability is lowered, with high strength.

CITATION LIST

Patent Literatures

Patent Literature 1: JP-A-63-312937 ("JP-A" means unexamined published Japanese patent application)

Patent Literature 2: JP-A-2002-294367
Patent Literature 3: JP-A-2006-152392
Patent Literature 4: JP-A-2011-132594
Patent Literature 5: WO 2011/068134 A1
Patent Literature 6: JP-A-2006-9108
Patent Literature 7: JP-A-2012-122114
Patent Literature 8: JP-A-2008-13836

SUMMARY OF INVENTION

Technical Problem

In Patent Literatures 1 to 4, high strength was obtained as compared to general copper alloys. However, there were occasions in which the electrical conductivity was still low, depending on the alloy system (the alloying composition) and the production method. Further, the control of Young's modulus, which is becoming especially important in recent years, was not attained. Further, in Patent Literatures 5 to 8, high electrical conductivity was obtained. However, the yield strength was low, and there was room for further enhancement in view of the control of Young's modulus.

Thus, there is a demand for a copper alloy sheet material having satisfactory electrical conductivity and high yield strength, and having its Young's modulus well controlled.

In view of the tasks as described above, the present invention is contemplated for providing: a copper alloy sheet material in which a balance is achieved among high yield strength, controlled Young's modulus, and satisfactory electrical conductivity; a connector using the copper alloy sheet material, and a method of producing the copper alloy sheet material. Particularly, the present invention is contemplated for providing: a copper alloy sheet material that is suitable for relays, switches, sockets and the like for electrical or electronic equipment; connectors, terminal materials and the like for automotive vehicles and the like; a copper alloy sheet material suitable for an electroconductive spring material to be used for electronic equipment components, such as an auto-focus camera module, and the like, a connector for flexible printed circuit (FPC), and the like; a connector using the copper alloy sheet material; and a method of producing the copper alloy sheet material.

Solution to Problem

The inventor of the present invention has conducted thorough investigations in order to solve the problems described above. As a result, the inventor of the present invention has found that when the degree of integration of the {110}<001> orientation and the {110}<112> orientation is increased, and the size of the maximum grains is controlled to be small, characteristics that Young's modulus is low in the direction parallel to the rolled direction, and that Young's modulus is high in the direction perpendicular to the rolled direction, are obtained, in addition to high yield strength and satisfactory electrical conductivity. The present invention was completed based on those findings.

That is, the present invention is to provide the following means:

(1) A copper alloy sheet material, having an alloy composition containing at least one of Ni and Co in an amount of 1.80 to 8.00 mass % in total, and Si in an amount of 0.40 to 2.00 mass %, with the balance being copper and unavoidable impurities, wherein the major axis of the grains in the matrix is 12 μm or less; and wherein the orientation density of the {110}<001> orientation is 4 or more, and the orientation density of the {110}<112> orientation is 10 or more.

(2) A copper alloy sheet material, having an alloy composition containing at least one of Ni and Co in an amount of 1.80 to 8.00 mass % in total, Si in an amount of 0.40 to 2.00 mass %, and at least one element selected from the group consisting of Sn, Zn, Ag, Mn, P, Mg, Cr, Zr, Fe, and Ti in an amount of 0.000 to 2.000 mass % in total, with the balance being copper and unavoidable impurities, wherein the major axis of the grains in the matrix is 12 μm or less; and wherein the orientation density of the {110}<001> orientation is 4 or more, and the orientation density of the {110}<112> orientation is 10 or more.

(3) The copper alloy sheet material described in item (2), which contains at least one element selected from the group consisting of Sn, Zn, Ag, Mn, P, Mg, Cr, Zr, Fe, and Ti in an amount of 0.005 to 2.000 mass % in total.

(4) The copper alloy sheet material described in any one of items (1) to (3), wherein a Vickers hardness is 280 or more.

(5) A connector formed to contain the copper alloy sheet material described in any one of items (1) to (4).

(6) A method of producing a copper alloy sheet material, comprising the steps of: melting and casting of raw materials having an alloying composition containing at least one of Ni and Co in an amount of 1.80 to 8.00 mass % in total, and Si in an amount of 0.40 to 2.00 mass %, with the balance being copper and unavoidable impurities; intermediate cold-rolling with a working ratio of 1% to 19%; aging treatment of performing a heat treatment for 5 minutes to 10 hours at 300° C. to 440° C.; and final cold-rolling with a working ratio of 95% or more, in this order.

(7) A method of producing a copper alloy sheet material, comprising the steps of: melting and casting of raw materials having an alloying composition containing at least one of Ni and Co in an amount of 1.80 to 8.00 mass % in total, Si in an amount of 0.40 to 2.00 mass %, and at least one element selected from the group consisting of Sn, Zn, Ag, Mn, P, Mg, Cr, Zr, Fe, and Ti in an amount of 0.000 to 2.000 mass % in total, with the balance being copper and unavoidable impurities; intermediate cold-rolling with a working ratio of 1% to 19%; aging treatment of performing a heat treatment for 5 minutes to 10 hours at 300° C. to 440° C.; and final cold-rolling with a working ratio of 95% or more, in this order.

(8) The method of producing a copper alloy sheet material described in item (7), wherein the copper alloy sheet material contains at least one element selected from the group consisting of Sn, Zn, Ag, Mn, P, Mg, Cr, Zr, Fe, and Ti in an amount of 0.005 to 2.000 mass % in total.

(9) The method of producing a copper alloy sheet material described in any one of items (6) to (8), which carries out, in this order, the steps of:

homogenization heat treatment of performing a heat treatment for one hour or more at 960° C. to 1,040° C.; and hot-working with a working ratio of 10% to 90% at a temperature range of 500° C. to 1,040° C. from the initiation to the end of the hot-working, between the melting and casting step and the intermediate cold-rolling step, and which carries out: no heat treatment at 480° C. or higher, after the hot-working step.

(10) The method of producing a copper alloy sheet material described in any one of items (6) to (9), which carries out a step of: stress-relief annealing of maintaining the copper alloy sheet material for 5 seconds to 2 hours at 200° C. to 430° C., after the final cold-rolling step.

Advantageous Effects of Invention

The copper alloy sheet material of the present invention has characteristics of high yield strength, low Young's modulus in the direction parallel to the rolled direction, and high Young's modulus in the direction perpendicular to the rolled direction. Therefore, both a spring having high Young's modulus and a spring having low Young's modulus can be produced, only by changing the pressing (die-cutting) direction for the sheet material. For this reason, the copper alloy sheet material of the present invention is preferable as a connector material. Further, the copper alloy sheet material of the present invention can be preferably used for: relays, switches, sockets and the like for electrical/electronic equipment; connectors, terminal materials and the like for automotive vehicles and the like; electroconductive spring materials to be used in electronic equipment components, such as auto-focus camera modules; connectors for flexible printed circuit (FPC); and the like.

Further, according to the method of producing a copper alloy sheet material of the present invention, the copper alloy sheet material having the excellent characteristics described above can be produced conveniently.

MODE FOR CARRYING OUT THE INVENTION

Figure 1:
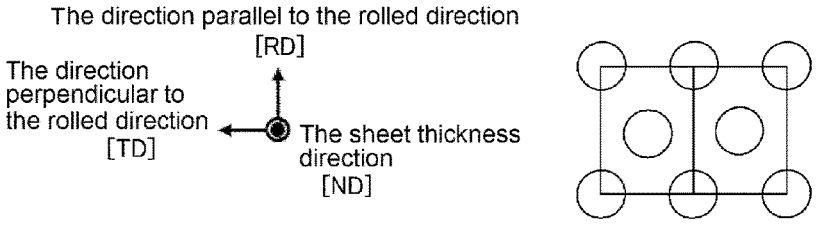
FIG. 1 shows the direction of the crystals of the {110}<001> orientation.

Preferable embodiments of the copper alloy sheet material of the present invention will be described in detail. Herein, the term "copper alloy material" means a product obtained after a copper alloy base material is worked into a predetermined shape (for example, sheet, strip, foil, rod, or wire). Among those, a sheet material refers to a material, which has a particular thickness, is stable in shape, and is extended in the planar direction, and in a broad sense, the sheet material is meant to include a strip material, a foil material, and a tube material obtained by working the sheet into a tube shape.

The Cu—(Ni, Co)—Si-based alloy to be used for the copper alloy sheet material of the present invention is a precipitation-hardened type alloy, and it is known that as a (Ni, Co)—Si-based compound is dispersed as particles having a size of approximately 10 nm in a copper matrix as a second phase, and that high strength is obtained. However, in such a crystal state, the control of Young's modulus and the balance are difficult to achieve, and therefore, the inventor of the present invention investigated different strengthening mechanisms. As a result, the inventor of the present invention has found that when grains having the {110}<001> orientation and the {110}<112> orientation are integrated to a large extent, Young's modulus can be controlled while high strength is obtained, by a synergistic effect obtainable by controlling the major axis of the largest grains among all the grains, to be small. Thus, the present invention was finally completed.

According to the present invention, the control of the crystals causes multiple slips in the slip deformation of crystals to a large extent, and thereby for enabling the balance between the strength enhancement and the control of Young's modulus.

(Measurement of X-Ray Pole Figure, and Orientation Density Given by ODF Analysis Based Thereon)

For the crystals of the copper alloy matrix in the copper alloy sheet material of the present invention, the incomplete pole figures of the {111}, {100}, and {110} planes are measured from the sheet material surface. The measurement is carried out by setting the sample size of the measurement surface to 25 mm×25 mm. The sample size can be made smaller by making the beam diameter of X-rays smaller. Based on three pole figures thus measured, an orientation distribution function (ODF) analysis is carried out. The orientation density represents how many times integration has been achieved when a random crystal orientation distribution state is designated as 1. This is commonly used as a method of quantitatively evaluating the crystal orientation distribution. Symmetry of the sample was made orthotropic (the object having mirror surfaces in RD and TD), and the order of expansion is $22^{nd}$ order. The orientation densities of the {110}<001> orientation and the {110}<112> orientation are determined. The orientation density of the {001}<100> orientation is also determined similarly.

Figure 2:
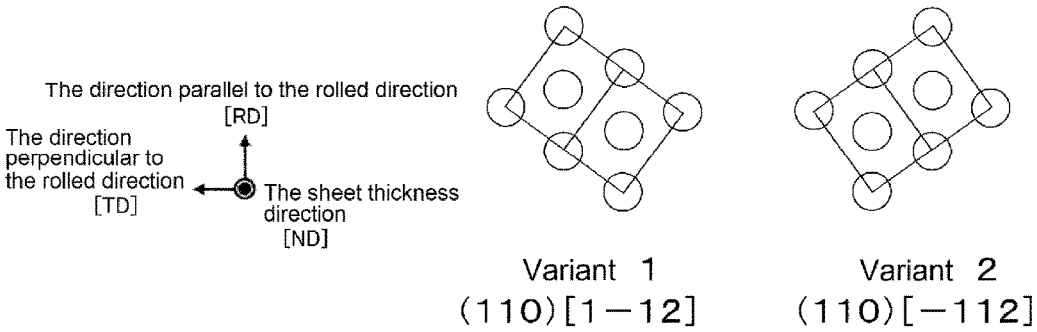
FIG. 2 shows the direction of the crystals of two variants of the {110}<112> orientation.
Figure 3:
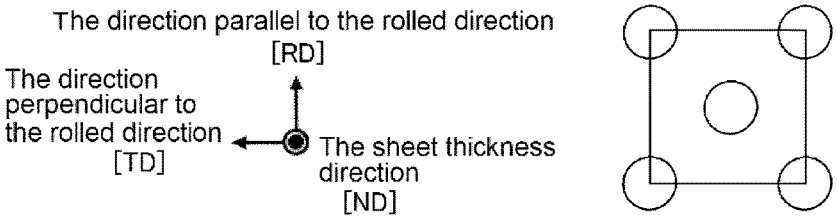
FIG. 3 shows the direction of the crystals of the {001}<100> orientation.

As illustrated in FIG. 1, FIG. 2, and FIG. 3, according to symmetry of the crystal, there is one variant of the {110}<001> orientation, there are two variants of the {110}<112> orientation, and there is one variant of the {001}<100> orientation. The orientation density in the present invention is defined by the orientation density just for one variant. Herein, the method of indicating the orientation is such that a Cartesian coordinate system is employed, representing the rolled direction (RD) of the sheet material in the X-axis, the transverse direction (TD) of the sheet material in the Y-axis, and the direction (ND) normal to the rolled direction of the sheet material in the Z-axis, various regions in the sheet material are indicated in the form of (h k l) [u v w], using the index (h k l) of the crystal plane that is perpendicular to the Z-axis (parallel to the rolled plane) and the index [u v w] of the crystal direction that is parallel to the X-axis (perpendicular to the rolled plane). The orientation is indicated by varying the kind of the parentheses, such that (hkl) [uvw] in the case where a single crystal orientation is expressed, and that {hkl}<uvw> in the case where all of the orientations that are equivalent under symmetry.

The ODF can also be obtained from a crystal orientation distribution measurement according to an EBSD method. Particularly, it is preferable to use an FE-SEM/EBSD method, in which the diameter of the electron beam is small, and in which the positional resolution is high. In the case of the EBSD method, the crystal orientation is determined using a Kikuchi pattern. However, in the case where the strain of the crystal lattice is large, the Kikuchi pattern becomes unclear, and the number of unanalyzable points increases. When these unanalyzable points occupy about 20% or less of all measurable points, measurement results are obtained that are equivalent to the analysis results for the texture based on X-ray pole figures. However, in the case where the measured viewing field is narrow in the measurement by the EBSD method, the orientation densities of the (110) [1-12] orientation and the (110) [−112] orientation, which are two variants of the {110}<112>, may differ. In that case, it is necessary to secure a large number of viewing fields so that the orientation densities of these equivalent orientation variants become equivalent.

Herein, FE-SEM/EBSD is an abbreviation for field emission electron gun-type scanning electron microscope/electron backscatter diffraction.

In the present invention, when the orientation density of the {110}<001> orientation evaluated by the method described above is 4 or more, and when the orientation density of the {110}<112> orientation is 10 or more, characteristics are obtained in which Young's modulus in the direction parallel to the rolled direction is low, and in which Young's modulus in the direction perpendicular to the rolled direction is high. The {110}<001> orientation is a crystal orientation in which the (001) plane faces the direction parallel to the rolled direction, and the {110}<112> orientation is a crystal orientation in which the (111) plane faces the direction perpendicular to the rolled direction. The {110}<001> orientation is an orientation effective for lowering Young's modulus in the direction parallel to the rolled direction, and the {110}<112> orientation is an orientation effective for enhancing Young's modulus in the direction perpendicular to the rolled direction. Therefore, when these orientation densities are set to predetermined quantities, characteristics are obtained in which Young's modulus in the direction parallel to the rolled direction is low, and in which Young's modulus in the direction perpendicular to the rolled direction is high. The orientation density of the {110}<001> orientation is more preferably 6 or more, and further preferably 8 or more. The orientation density of the {110}<112> orientation is more preferably 15 or more, and further preferably 20 or more. The upper limit of each orientation density is not particularly limited, but the upper limit is usually 100 or less. In the present invention, more preferably, the orientation density of the {110}<001> orientation is 6 or more, and the orientation density of the {110}<112> orientation is 15 or more; and even more preferably, the orientation density of the {110}<001> orientation is 8 or more, and the orientation density of the {110}<112> orientation is 20 or more. If any of these orientation densities is too low, it is difficult to obtain characteristics in which Young's modulus in the direction parallel to the rolled direction is low, and in which Young's modulus in the direction perpendicular to the rolled direction is high.

Further, the orientation density of the {001}<100> orientation is preferably 3 or less. The orientation density of the {001}<100> orientation is more preferably 2 or less, and further preferably 1 or less. The orientation density of the {001}<100> orientation is particularly preferably 0, that is, it is particularly preferable that grains of the {001}<100> orientation do not exist at all. This is because if the orientation density of the {001}<100> orientation is too high, Young's modulus in the direction perpendicular to the rolled direction is lowered.

In the present invention, since an abnormal worked structure, such as a work-damaged layer (a work-affected layer), is formed at the outermost surface of the sheet, evaluation results that are different from the bulk crystal orientation distribution may be obtained. Therefore, it is preferable to perform half-etching and then to measure the orientation density at a position equivalent to a half of the sheet thickness.

In the present invention, "X'PERT PRO" manufactured by PANalytical B.V. is used for the measurement of the X-ray pole figures, and an analytical software "STANDARD ODF" of Norm Engineering Pty. Ltd. is used for an ODF analysis.

Further, regarding the EBSD measurement, "JSM-7001F" of JEOL, Ltd. is used for FE-SEM with an electron beam source, and "OIM5.0 HIKARI" of TSL Solutions, Ltd. is used as a camera for analyzing a Kikuchi pattern for EBSD analysis.

Further, a software program of TSL Solutions, Ltd., "OIM ANALYSIS 5", is used for an analysis of EBSD data.

In the present invention, the crystal orientation distribution function (ODF) can be determined by a series expansion method, through calculation in which odd numbered terms are also introduced. The calculation method of odd numbered terms is as described in, for example, Light Metals, written by Hiroshi Inoue, "Three-dimensional orientation analysis for texture", pp. 358-367 (1992); Journal of Japan Institute of Metals and Materials, written by Hiroshi Inoue et al., "Determination of crystal orientation distribution function from incomplete pole figures according to repeated series expansion method", pp. 892-898, Vol. 58 (1994); and by U. F. Kocks et al., "Texture and Anisotropy", pp. 102-125, Cambridge University Press (1998).

(Major Axis of Maximum Grains)

The major axis of the maximum grain is analyzed by measuring the major axis according to an EBSD method. Usually, the strength of a precipitation-hardened type alloy is greatly dominated by the dispersed state, such as the size or density of the precipitate, and the influence of the grain diameter is small. However, in regard to the control of crystals in the present invention, it is important to appropriately control the size of the grains, particularly the size of the largest grains. A crystal orientation map is measured by scanning an electron beam at an interval of 0.1 μm according to the FE-SEM/EBSD method described above, and a boundary at which the difference of orientation is 5° or more is designated as a grain boundary. A domain surrounded by grain boundaries is designated as one grain. The viewing field for observation is set to be 50 μm×50 μm, and measurement is performed in three viewing fields each time. Then, for the largest grain among them, the particle size, that is, the length of the major axis was determined. Herein, the major axis refers to the longest particle diameter observed on a crystal orientation map for one grain in the rolled direction (RD), the transverse direction (TD), or any one direction intermediate of the rolled direction and the transverse direction.

In this specification, this length of the major axis of the largest grain is also referred to as the maximum value (L) of the major axis of the grain or the major axis of the maximum grain. This is the meaning of the major axis of a grain of the matrix, as defined in the present invention. In the case where the major axis of a grain of the matrix is 12 μm or less, satisfactory high strength, that is, predetermined high yield strength, is obtained. The major axis of the grain of the matrix is more preferably 9 μm or less, and even more preferably 4 μm or less. It is also possible to perform the analysis of the grains described above, based on the observation results made using a transmission electron microscope.

Figure 4:
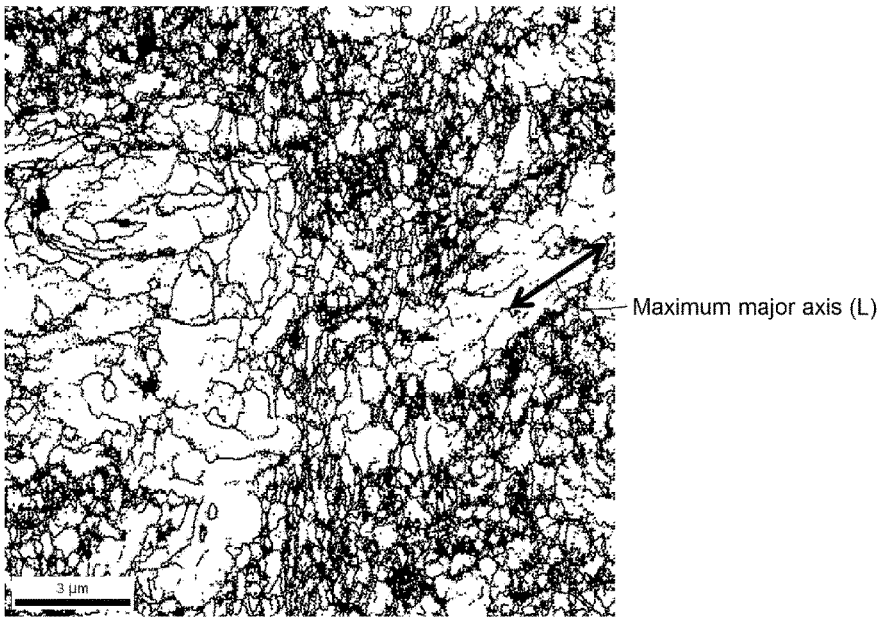
FIG. 4 is a grain boundary map of Example 204 obtained via FE-SEM/EBSD measurement.
Figure 5:
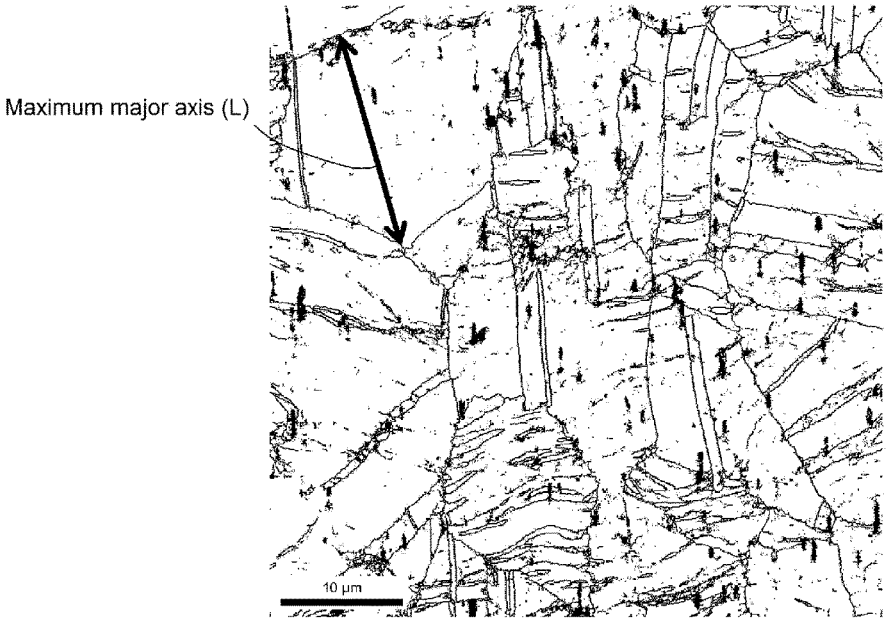
FIG. 5 is a grain boundary map of Comparative Example 256 obtained via FE-SEM/EBSD measurement.

Grain boundary maps obtained by FE-SEM/EBSD measurement are presented in FIG. 4 for Example 204, and in FIG. 5 for Comparative Example 256. Lines in the diagrams represent the grain boundaries, and individual domains surrounded by the grain boundaries are grains. The maximum value (L) of the major axis of a grain is as illustrated in the diagram.

(Alloying Composition)

Ni, Co and Si

These are elements that constitute the second phase described above. These form the intermetallic compounds. These are essentially adding elements in the present invention. The sum total of the contents of at least one of Ni and Co is 1.8 to 8.0 mass %, preferably 2.6 to 6.5 mass %, and more preferably 3.4 to 5.0 mass %. Further, the content of Si is 0.4 to 2.0 mass %, preferably 0.5 to 1.6 mass %, and more preferably 0.7 to 1.2 mass %. In the case where the amount of addition of any of these essentially adding elements is too small, the obtainable effects may become insufficient; and in the case where the amount of addition is too large, material cracking may occur in rolling steps. When Co is added, electrical conductivity is slightly improved. However, in the case where the concentrations of any of these essentially adding elements are high in a state of containing Co, rolling cracks may be apt to occur, depending on the conditions of hot-rolling and cold-rolling. Therefore, a more preferred embodiment in the present invention does not contain Co at all.

Other Elements

The copper alloy sheet material of the present invention may contain, in addition to the essentially adding elements, at last one element selected from the group consisting of Sn, Zn, Ag, Mn, P, Mg, Cr, Zr, Fe, and Ti, as an optionally adding element(s). It has been confirmed that any of these elements increase the orientation densities of the {110}<001> orientation and the {110}<112> orientation, and also have an action of lowering the maximum value (L) of the major axis of grains and improving the Vickers hardness (Hv). In the case of containing any of these elements, the content of at least one element selected from the group consisting of Sn, Zn, Ag, Mn, P, Mg, Cr, Zr, Fe, and Ti is preferably set to 0.005 to 2.0 mass % in total. However, if the content of any of these optionally adding elements is too large, there may be an adverse affect of lowering the electrical conductivity, or material cracking may occur in rolling steps.

Unavoidable Impurities

Unavoidable impurities in the copper alloy are conventional elements that are contained in a copper alloy. Examples of the unavoidable impurities include O, H, S, Pb, As, Cd, and Sb. Any of these are tolerated to be contained up to a total amount of about 0.1 mass %.

(Production Method)

As a conventional method, in a usual method of producing a precipitation-hardened type copper alloy material, a supersaturated solid solution state is attained by a solution heat treatment, then the copper alloy material is subjected to precipitation by an aging treatment, and if necessary, the copper alloy material is subjected to temper rolling (finish rolling) and stress-relief annealing. Production methods E, F, G, and H of Comparative Examples described below correspond to this conventional method.

To the contrary, in the present invention, in order to control the crystal orientation and the major axis of the maximum grain, a process different from the conventional method becomes effective. For example, a process such as described below is effective. However, as long as the crystal state as defined in the present invention is satisfied, the production method is not intended to be limited to the method described below.

An example of the method of producing the copper alloy sheet material of the present invention may include: melting and casting [Step 1] to obtain an ingot; subjecting this ingot to homogenization heat treatment [Step 2]; hot-working [Step 3], such as hot-rolling; water-cooling [Step 4]; intermediate cold-rolling [Step 5]; heat treatment for aging-precipitation [Step 6]; final cold-rolling [Step 7]; and stress-relief annealing [Step 8], in this order. The stress-relief annealing [Step 8] may be omitted if predetermined crystal control and physical properties are obtained. In the present invention, no solution heat treatment is carried out. That is to say, no heat treatment at 480° C. or higher is carried out, in the steps after the hot-rolling.

Alternatively, another example of the method of producing the copper alloy sheet material of the present invention may include: melting and casting [Step 1] to obtain an ingot; subjecting this ingot to intermediate cold-rolling [Step 5]; heat treatment for aging-precipitation [Step 6]; final cold-rolling [Step 7]; and stress-relief annealing [Step 8], in this order. In this case, it is preferable that a copper alloy has been subjected to homogenization of the alloying elements or adjustment of the sheet thickness, at the time point of the melting and casting [Step 1]. In this process as well, the stress-relief annealing [Step 8] may be omitted as long as predetermined crystal control and physical properties are obtained. Also in this case, in the present invention, no solution heat treatment is carried out. That is to say, no heat treatment at 480° C. or higher is carried out, in the steps after the hot-rolling.

The control of the crystal orientation and the size of the grains as defined in the present invention is achieved by a combination of particular conditions in two steps, such as that, for example, the conditions for the aging treatment [Step 6] are set to 300° C. to 440° C. for 5 minutes to 10 hours, and the working ratio of the final cold-rolling [Step 7] is set to 95% or more. This mechanism is estimated as follows. In the heat treatment of the aging treatment [Step 6], the action of a (Ni, Co)—Si compound precipitated into a fine size of several nanometers or less causes a change in the distribution state of displacements or the crystal rotation in the final cold-rolling [Step 7]. Then, by taking a high value for the rolling ratio of the final cold-rolling [Step 7], fragmentation of grains in the final cold-rolling [Step 7] is induced, the particle size of the maximum grains is made small, and also, crystal rotation and integration into the {110}<001> orientation and the {110}<112> orientation are accelerated. When these maximum grains are made small in size, strength is enhanced, and Vickers hardness is made high.

Herein, in regard to the action of the precipitate, in conventional Cu—(NI, Co)—Si-based alloys, by inducing precipitation of a precipitate having a size of approximately 10 nm, the precipitate itself serves as a resistance to displacement and enhances strength. On the contrary, in the present invention, a significant difference lies in that the action of the precipitate is utilized for the control of the orientation and size of crystals by cold working. Through the discovery of this new action and the new way of texture control achieved by utilizing the discovery, a balance of the characteristics can be achieved among Young's modulus E(RD) that is low in the direction parallel to the rolled direction, Young's modulus E(TD) that is high in the direction perpendicular to the rolled direction, and high yield strength, which cannot be excerpted conventionally.

Preferable conditions for the heat treatments and the workings in the steps, are as follows.

The homogenization heat treatment [Step 2] is maintained at 960° C. to 1,040° C., for one hour or longer, and preferably for 5 to 10 hours.

The hot-working [Step 3], such as hot-rolling, is carried out such that the temperature range from the initiation to the end of the hot-working is 500° C. to 1,040° C., and the working ratio is 10% to 90%.

The water cooling [Step 4] is carried out, usually, at a cooling speed of 1° C./sec to 200° C./sec.

The intermediate cold-rolling [Step 5] is carried out at a working ratio of 1% to 19%.

The heat treatment for the age-precipitation [Step 6] is also called an aging treatment, and the conditions thereof are retention for 5 minutes to 10 hours at 300° C. to 440° C., and a preferred temperature range is 360° C. to 410° C.

The working ratio of the finish cold-rolling [Step 7] is 95% or higher, and preferably 97% or higher. The upper limit is not particularly limited, but the working ratio is usually 99.999% or less.

The stress-relief annealing [Step 8] involves retention for 5 seconds to 2 hours at 200° C. to 430° C. If the retention time is too long, strength is lowered. Then, it is preferable to perform annealing for a short time of from 5 seconds to 5 minutes.

Herein, the working ratio (or rolling ratio) is a value defined by the following expression.

$$\text{Working ratio } (\%)=\{(t_1-t_2)/t_1\}\times 100$$

wherein $t_1$ represents the thickness before rolling, and $t_2$ represents the thickness after rolling.

(Physical Properties)

The copper alloy sheet material of the present invention preferably has the following physical properties.

(Vickers Hardness: Hv)

The yield strength characteristics in the present invention are quantitatively determined by Vickers hardness obtained by a Vickers hardness test, which is almost in a proportional relationship with yield strength and which can be quantitatively determined with a smaller specimen as compared to yield strength.

The Vickers hardness of the copper alloy sheet material of the present invention is preferably 280 or more, more preferably 295 or more, and even more preferably 310 or more. The upper limit of this Vickers hardness of the sheet material is not particularly limited, but when punching-pressing workability and the like are also considered, the Vickers hardness of 400 or less is preferred. The Vickers hardness in this specification refers to a value measured according to JIS Z 2244. When the Vickers hardness is within this range, yield strength also has a high value, and an effect is excerpted in which a sufficient contact pressure of an electrical contact can be secured in the case where the copper alloy sheet material of the present invention is used for a connector or the like.

(Yield Strength: YS)

In one preferred embodiment of the copper alloy sheet material of the present invention, the yield strength in the direction perpendicular to the rolled direction (also referred to as yield stress or 0.2% yield stress) is preferably 1,020 MPa or more, more preferably 1,080 MPa or more, and even more preferably 1,140 MPa or more. In the present invention, the average value of the yield strength in the direction parallel to the rolled direction and the yield strength in the direction perpendicular to the rolled direction is employed as the value of yield strength of the copper alloy sheet material. The upper limit of this yield strength of the sheet material is not particularly limited, but, for example, the yield strength is 1,400 MPa or less.

(Young's Modulus: E)

Young's modulus in the direction parallel to the rolled direction (E(RD)) is preferably 128 GPa or less, more preferably 125 GPa or less, and even more preferably 122 GPa or less. The lower limit of this Young's modulus in the direction parallel to the rolled direction is not particularly limited, but the lower limit is usually 100 GPa. Young's modulus in the direction perpendicular to the rolled direction (E(TD)) is preferably 135 GPa or more, more preferably 139 GPa or more, and even more preferably 143 GPa or more. The upper limit of this Young's modulus in the direction perpendicular to the rolled direction is not particularly limited, but the upper limit is usually 160 GPa.

(Electrical Conductivity: EC)

The electrical conductivity is preferably 13% IACS or higher, more preferably 15% IACS or higher, even more preferably 17% IACS or higher, and particularly preferably 19% IACS or higher. In regard to the upper limit of the electrical conductivity, if the electrical conductivity exceeds 40% IACS, strength may be lowered. The electrical conductivity is preferably 40% IACS or less, more preferably 34% IACS or less, and even more preferably 31% IACS or less.

In the present invention, yield strength is a value based on JIS Z 2241. Further, the term "% IACS" represents the electrical conductivity in the case where the resistivity of $1.7241\times10^{-8}$ Ωm of the International Annealed Copper Standards is designated as 100% IACS.

(Sheet Thickness Range of Product)

In one embodiment of the copper alloy sheet (copper alloy strip) according to the present invention, the thickness is 0.6 mm or less, and in a typical embodiment, the thickness is 0.03 mm to 0.3 mm.

EXAMPLES

The present invention will be described in more detail based on examples given below, but the invention is not meant to be limited by these.

Example 1

Raw materials of each alloy containing the alloying elements described in Table 1, with the balance being Cu and unavoidable impurities, were melted with a high-frequency melting furnace, and this was cast to obtain an ingot. The ingot was subjected to rollings at the rolling ratios described in the following steps, and thereby the size of the ingot was set to obtain the final sheet thickness (0.15 mm) without contradiction. Then, specimens of copper alloy sheet materials of Examples according to this invention and of Comparative Examples apart from those Examples, were respectively produced, by any one of the following production methods A, B, C, and D. Table 1 shows which production method among the methods A to D was used. The final thickness of the copper alloy sheet material was set to 0.15 mm, unless otherwise specified. This final sheet thickness is also the same in the cases of production methods E to H that will be described below, unless otherwise specified. The numbers or the like indicated with underlines in the table mean: whether the content of alloying elements, the orientation density, the maximum value (L) of the major axis of grains, or the production method, as defined in the present invention, is not satisfied; or whether the physical properties do not satisfy the preferred ranges in the present invention.

(Production Method A)

The ingot was subjected to a homogenization heat treatment of maintaining the ingot for one hour or longer at 960° C. to 1,040° C., and while kept in this high temperature state, the ingot was subjected to hot-rolling to obtain a sheet thickness of 12 mm. Then, the sheet material was immediately water-cooled. Then, after face-milling (chamfering), intermediate cold-rolling at a working ratio of 1% to 19%, an aging treatment of maintaining for 5 minutes to 10 hours at 300° C. to 440° C., finish cold-rolling at a working ratio of 95% or more, and stress-relief annealing were carried out, in this order.

(Production Method B)

Without performing the homogenization heat treatment and the hot-rolling of the production method A, after face-milling, the ingot was subjected to cold-rolling at a working ratio of 1% to 19%, an aging treatment of maintaining for 5 minutes to 10 hours at 300° C. to 440° C., finish cold-rolling at a working ratio of 95% or more, and stress-relief annealing, in this order.

(Production Method C)

The aging treatment of the production method A was carried out under the conditions of maintaining for 5 minutes to 10 hours at a temperature of higher than 500° C. and 700° C. or lower, and for the other conditions, the production was carried out in the same manner as in the production method A.

(Production Method D)

The finish cold-rolling of the production method A was carried out at a working ratio of 80% or higher but lower than 94%, and for the other conditions, the production was carried out in the same manner as in the production method A.

The conditions for the stress-relief annealing for the production methods A to D were set to 5 seconds to 2 hours of retention at 200° C. to 430° C. After the heat treatments or rollings, the oxide layer at the surface was removed, if necessary, by face-milling, acid-washing, or surface-polishing, depending on the state of oxidation or roughness of the material surface. Further, if necessary, the sheet materials were subjected to correction by a tension leveler, depending on the shape. Further, in the case where the roughness of the material surface was large due to the transfer of surface unevenness of the rolling rolls or due to oil pits, the rolling conditions, such as the rolling speed, rolling oil, diameter of the rolling rolls, surface roughness of the rolling rolls, and the amount of rolling reduction in one pass at the time of rolling, were regulated.

Further, specimens of copper alloy sheet materials were obtained through test production by any one of the following production methods E, F, G, and H, as other Comparative Examples. For the conditions of the production methods E to H, the conditions for the production methods described in the Patent Literatures were followed. However, since the conditions for the solution heat treatment varied depending on the concentrations of adding alloying elements in the alloys, conditions for a solution heat treatment of maintaining at 900° C. for 1 minute were employed, as the conditions for sufficiently forming a solid solution with the concentrations of alloying elements in Example 104 and the like according to those Examples, such as Ni=3.81 mass % and Si=0.91 mass %.

(Production Method E) Production Method Described in Example of Patent Literature 5: WO 2011/068134 A1

Raw materials that would provide a copper alloy composition indicated in Table 1 were cast by a DC method, and an ingot having a thickness of 30 mm, a width of 100 mm, and a length of 150 mm was obtained. Then, this ingot was heated to 800° C. to 1,000° C. and maintained at this temperature for one hour, and then the ingot was hot-rolled to obtain a thickness of 14 mm. The resultant sheet was subjected to gradually cooling at a cooling speed of 1 K/second, and when the temperature reached 300° C. or lower, the resultant sheet was water-cooled. Then, two surfaces were face-milled by 2 mm each to remove oxide films, and then the resultant sheet was subjected to cold-rolling at a rolling ratio of 90% to 95%. Thereafter, the resultant sheet was subjected to intermediate annealing for 30 minutes at 350° C. to 700° C., and cold-rolling at a cold-rolling ratio of 10% to 30%. Thereafter, a solution treatment for 5 seconds to 10 minutes at 700° C. to 950° C. was carried out, and the resultant sheet was immediately cooled at a cooling speed of 15° C./second or more. Then, the resultant sheet was subjected to an aging treatment for 2 hours at 400° C. to 600° C. in an inert gas atmosphere, and then was subjected to finish rolling at a rolling ratio of 50% or less. Thus, a final sheet thickness of 0.15 mm was obtained. After the finish rolling, the product was subjected to the stress-relief annealing for 30 seconds at 400° C.

(Production Method F) Production Method Corresponding to Example No. 1 of Example 1 described in Patent Literature 6: JP-A-2006-9108

Raw materials that would provide a copper alloy composition indicated in Table 1 were melted with an air-melting furnace, and an ingot having a size of 20 mm in thickness× 60 mm in width was cast. This ingot was subjected to homogenization annealing for 3 hours at 1,000° C., and then hot-rolling was initiated at this temperature. At a time point at which the thickness of the ingot reached 15 mm, 10 mm, or 5 mm, the material in the mid course of rolling was re-heated for 30 minutes to 1,000° C., and after hot-rolling, the material was worked to obtain a sheet thickness of 3 mm. Thereafter, the resultant sheet was subjected to face-milling, cold-rolling to obtain a sheet thickness of 0.625 mm (working ratio, 79%), a solution treatment of maintaining the material for one minute at 900° C., water-cooling, cold-rolling to obtain a sheet thickness of 0.5 mm (working ratio, 20%), and an aging treatment of maintaining the material for 3 hours at 400° C. to 600° C., in this order.

(Production Method G) Production Method Corresponding to Example 3 Described in Patent Literature 7: JP-A-2012-122114

Raw materials which would provide a copper alloy composition indicated in Table 1 were melted with a low-frequency melting furnace in a reducing atmosphere, and then were cast to produce a copper alloy ingot having a dimension of 80 mm in thickness, 200 mm in width, and 800 mm in length. This copper alloy ingot was heated to 900° C. to 980° C., and then was subjected to hot-rolling to obtain a hot-rolled sheet having a thickness of 11 mm. This hot-rolled sheet was water-cooled, and then two faces thereof were face-milled by 0.5 mm each. Then, the resultant sheet was subjected to cold-rolling at a rolling ratio of 87% to produce a cold-rolled sheet having a thickness of 1.3 mm, and then the cold-rolled sheet was subjected to continuous annealing under the conditions of maintaining the cold-rolled sheet for 7 to 15 seconds at 710° C. to 750° C. The resultant cold-rolled sheet was subjected to cold-rolling at a working ratio of 55% (cold-rolling immediately before a solution treatment), and thus a cold-rolled sheet having a predetermined thickness was produced. This cold-rolled sheet was maintained for one minute at 900° C., and then was rapidly cooled to apply a solution treatment. The resultant sheet was subjected to an aging treatment by maintaining the sheet for 3 hours at 430° C. to 470° C. Then, the resultant sheet was subjected to mechanical polishing with particles having a particle size of #600, and an acid-washing treatment of immersing the sheet in a treatment liquid obtained by mixing 5 mass % of sulfuric acid and 10 mass % of hydrogen peroxide, for 20 seconds at a liquid temperature of 50° C.

The resultant sheet was subjected to final cold-rolling at a working ratio of 15%, and was then subjected to continuous stress-relief annealing under the conditions of maintaining the sheet for 20 to 60 seconds at 300° C. to 400° C. Thus, a thin copper alloy sheet was produced.

(Production Method H) Production Method Corresponding to Example No. 4 Described in Patent Literature 8: JP-A-2008-13836

Raw materials that would provide a copper alloy composition indicated in Table 1 were melted, and the molten metal was cast with a vertical-type continuous casting machine. The slab (ingot) thus obtained was heated to 950° C. and was subjected to hot-rolling in a temperature range of 950° C. to 650° C., to thereby obtain a sheet material having a thickness of 10 mm. Thereafter, the sheet material was rapidly cooled (water-cooling). Then, the sheet material was subjected to face-milling, cold-rolling at a rolling ratio of 91%, a solution treatment (for 1 minute at 900° C.) to obtain an average grain diameter of more than 25 μm and 40 μm or less, an aging treatment of maintaining the sheet at 450° C. for a time period in which hardness would reach a peak value, final cold-rolling at a rolling ratio of 35% (to obtain a sheet thickness of 0.2 mm), and stress-relief annealing of maintaining the sheet for 5 minutes at 400° C., in this order.

With respect to the specimens of these Examples according to this invention and Comparative Examples, characteristics were measured and evaluated as follows. The results are presented together in Table 1.

a. Orientation Density

For a half-etched sheet, incomplete pole figures of {111}, {100}, and {110} were measured at a position equivalent to one half of the sheet thickness. The sample size of the measured surface was set to be 25 mm×25 mm. An ODF analysis was carried out, based on three pole figures thus measured. Symmetry of the sample was made orthotropic (the object having mirror surfaces in RD and TD), and the order of expansion was set to the $22^{nd}$ order. Then, the orientation densities of the {110}<001> orientation and the {110}<112> orientation, were determined. In addition, the orientation density of the {001}<100> orientation, was also determined.

b. Maximum Value [L] of Major Axis of Grains of Matrix

A crystal orientation map was measured and produced by scanning a sample with an electron beam at an interval of 0.1 μm according to the FE-SEM/EBSD method. Herein, a boundary at which the orientation difference was 5° or more was designated as a grain boundary. The viewing field for observation was set to be 50 μm×50 μm, and measurement was made in three viewing fields each time. Among them, for the grain having the largest particle size, the major axis of the grain was determined. That is, the maximum major axis of the grains of the matrix of the copper alloy sheet material of the present invention was determined.

c. Vickers Hardness [Hv]

According to JIS Z 2244, Vickers hardness was measured from a material surface or from a section that had been mirror-surface polished. The load was set to 100 gf, and the average of n=10 was determined.

d. Yield Strength [YS]

Test specimens of JIS Z2201 No. 13B that were cut out separately from the respective specimens by taking any one of the direction parallel to the rolled direction (RD) or the direction perpendicular to the rolled direction (TD) as a longitudinal side, were prepared, and measurement was made with three specimens for each sample according to JIS Z2241. Displacements were measured using a contact-type extensometer, a stress-strain curve was obtained, and the 0.2% yield strength was read therefrom. Then, the average value of the yield strength in the direction parallel to the rolled direction: YS (RD) and the yield strength in the direction perpendicular to the rolled direction: YS (TD), was designated as the yield strength.

e. Young's Modulus [E]

A stress-strain curve was obtained by the same method as in the measurement of the yield strength [YS] described above, and the gradient of the elastic region was read therefrom. This was designated as Young's modulus. Young's modulus in the direction parallel to the rolled direction: E(RD) and Young's modulus in the direction perpendicular to the rolled direction: E(TD) were respectively determined.

f. Electrical Conductivity [EC]

The electrical conductivity was calculated by using the four-terminal method to measure the specific resistance of the respective specimen in a thermostat bath that was maintained at 20° C. (±0.5° C.). The spacing between terminals was set to 100 mm.

TABLE 1

| | | Ni mass % | Co mass % | Si mass % | Production Method | {110} <001> orientation density | {110} <112> orientation density | {001} <100> orientation density |
|---|---|---|---|---|---|---|---|---|
| Example | 101 | — | 1.84 | 0.43 | A | 7 | 12 | 1 |
| | 102 | 2.62 | — | 0.57 | A | 10 | 23 | 0 |
| | 103 | 2.41 | 1.25 | 0.88 | A | 7 | 21 | 0 |
| | 104 | 3.81 | — | 0.91 | A | 9 | 25 | 0 |
| | 105 | 3.21 | 1.35 | 1.05 | A | 10 | 22 | 0 |
| | 106 | 4.62 | — | 1.15 | A | 11 | 24 | 0 |
| | 107 | 6.43 | — | 1.52 | B | 7 | 17 | 0 |
| | 108 | 7.85 | — | 1.86 | B | 5 | 12 | 1 |
| Comparative | 151 | 1.72 | — | 0.37 | A | 7 | 13 | 1 |
| Example | 152 | 8.25 | — | 2.11 | | Cracks of the material were occurredinrolling | | |
| | 153 | 3.81 | — | 0.91 | C | 5 | 12 | 1 |
| | 154 | 3.81 | — | 0.91 | D | 3 | 8 | 1 |
| | 155 | 3.81 | — | 0.91 | E | 2 | 5 | 23 |
| | 156 | 3.81 | — | 0.91 | F | 4 | 5 | 1 |
| | 157 | 3.81 | — | 0.91 | G | 4 | 4 | 1 |
| | 158 | 3.81 | — | 0.91 | H | 3 | 3 | 1 |

TABLE 1-continued

| | | Maximum value L of major axis of grains μm | Hardness Hv | Yield strength YS MPa | Young's modulus E (RD) GPa | Young's modulus E (TD) GPa | Electrical conductivity EC % IACS |
|---|---|---|---|---|---|---|---|
| Example | 101 | 8.8 | 283 | 1,024 | 126 | 138 | 31.2 |
| | 102 | 3.3 | 287 | 1,052 | 121 | 147 | 27.5 |
| | 103 | 3.2 | 312 | 1,155 | 120 | 146 | 30.2 |
| | 104 | 3.1 | 319 | 1,175 | 119 | 148 | 28.3 |
| | 105 | 3.8 | 323 | 1,180 | 120 | 146 | 30.9 |
| | 106 | 3.7 | 329 | 1,205 | 120 | 147 | 25.3 |
| | 107 | 8.7 | 332 | 1,218 | 124 | 142 | 18.4 |
| | 108 | 11.5 | 342 | 1,252 | 127 | 138 | 16.1 |
| Comparative Example | 151 | 8.9 | 268 | 985 | 127 | 137 | 31.7 |
| | 152 | Cracks of the material were occurredinrolling | | | | | |
| | 153 | 13.7 | 262 | 958 | 129 | 134 | 29.8 |
| | 154 | 7.3 | 263 | 962 | 130 | 132 | 28.2 |
| | 155 | 15.6 | 230 | 808 | 106 | 113 | 41.2 |
| | 156 | 13.5 | 232 | 810 | 127 | 133 | 39.3 |
| | 157 | 17.3 | 225 | 793 | 126 | 131 | 38.8 |
| | 158 | 14.2 | 228 | 798 | 127 | 133 | 40.2 |

As shown in Table 1, Examples 101 to 108 that satisfied the definitions in the present invention, each exhibited excellent characteristics. As the concentrations of Ni/Co or Si were higher in the predetermined ranges, the Examples exhibited higher yield strength YS.

On the other hand, in Comparative Examples, since the alloy compositions did not satisfy the conditions defined in the present invention, at least one of the orientation density of the {110}<001> orientation, the orientation density of the {110}<112> orientation, and the maximum value L of the major axis of the grains of the matrix did not satisfy the conditions defined in the present invention. Therefore, Comparative Examples were poor in at least one characteristics among Vickers hardness Hv, yield strength YS, Young's modulus in the direction parallel to the rolled direction E(RD), and Young's modulus in the direction perpendicular to the rolled direction E(TD).

In Comparative Example 151, since the concentrations of Ni/Co and Si were too low, the yield strength YS was poor. Further, in Comparative Example 152 in which the concentrations of Ni/Co and Si were too high, hot-rolling cracks occurred, and the resultant material exhibited poor manufacturability. In Comparative Example 153 produced by the production method C, the maximum value L of the major axis of the grains of the matrix was too large. Further, in Comparative Example 154 produced by the production method D, the orientation densities of the {110}<001> orientation and the {110}<112> orientation were too small. In these Comparative Examples 153 and 154, the yield strength YS was too low in both materials, and Young's modulus in the direction parallel to the rolled direction E(RD) was too high, while Young's modulus in the direction perpendicular to the rolled direction E(TD) was too low. Thus, the materials could not be controlled to have desired Young's modulus values, and were poor.

As other Comparative Examples, in Comparative Examples 155, 156, 157, and 158 produced by the production methods E, F, G, and H, in each case, the orientation density of the {110}<112> orientation was too low, and the maximum value L of the major axis of the grains of the matrix was too large, the yield strength YS was too low, and Young's modulus in the direction perpendicular to the rolled direction E(TD) was too low. Thus, the materials could not be controlled to have desired Young's modulus values, and each were poor. Among these, in Comparative Examples 155 and 158, the orientation density of the {110}<001> orientation was too small, and in Comparative Example 155, the orientation density of the {001}<100> orientation was too large.

Further, Comparative Examples 151 and 153 to 158 each had also a poor Vickers hardness Hv.

Example 2

Copper alloy sheet materials were produced using the copper alloys described in Table 2, and characteristics thereof were evaluated, by the same production methods and the same test and measurement methods as those used in Example 1. The results are presented in Table 2.

TABLE 2

| | | Ni mass % | Co mass % | Si mass % | Other elements mass % | Production Method | {110} <001> orientation density | {110} <112> orientation density | {001} <100> orientation density |
|---|---|---|---|---|---|---|---|---|---|
| Example | 201 | — | 1.82 | 0.45 | Zr = 0.11, Mn = 0.06 | A | 8 | 13 | 1 |
| | 202 | 2.64 | — | 0.59 | Mg = 0.15 | A | 12 | 25 | 0 |
| | 203 | 2.42 | 1.22 | 0.89 | Zn = 1.92, Ag = 0.12 | A | 9 | 22 | 0 |
| | 204 | 3.78 | — | 0.91 | Mg = 0.08 | A | 10 | 26 | 0 |
| | 205 | 3.25 | 1.33 | 1.02 | Cr = 0.15 | A | 12 | 23 | 0 |
| | 206 | 4.65 | — | 1.13 | Mg = 0.12 | A | 13 | 26 | 0 |
| | 207 | 6.41 | — | 1.55 | Sn = 0.52 | B | 9 | 18 | 0 |
| | 208 | 7.88 | — | 1.83 | Fe = 0.23, P = 0.05 | B | 6 | 14 | 1 |
| Comparative Example | 251 | 2.64 | — | 0.59 | Sn =2.12 | Cracks of the material were occurredinrolling | | | |
| | 252 | 3.81 | — | 0.91 | Mg = 0.15 | C | 5 | 12 | 1 |
| | 253 | 3.81 | — | 0.91 | Mg = 0.15 | D | 3 | 9 | 1 |

TABLE 2-continued

| | | | | | | | | |
|---|---|---|---|---|---|---|---|---|
| 254 | 3.81 | — | 0.91 | Mg = 0.15 | E | 2 | 5 | 18 |
| 255 | 3.81 | — | 0.91 | Mg = 0.15 | F | 4 | 5 | 1 |
| 256 | 3.81 | — | 0.91 | Mg = 0.15 | G | 4 | 4 | 1 |
| 257 | 3.81 | — | 0.91 | Mg = 0.15 | H | 3 | 3 | 1 |

| | | Maximum value L of major axis of grains μm | Hardness Hv | Yield strength YS MPa | Young's modulus E (RD) GPa | Young's modulus E (TD) GPa | Electrical conductivity EC % IACS |
|---|---|---|---|---|---|---|---|
| Example | 201 | 6.3 | 283 | 1,030 | 125 | 139 | 30.1 |
| | 202 | 3.1 | 288 | 1,055 | 120 | 148 | 26.8 |
| | 203 | 2.8 | 317 | 1,160 | 110 | 147 | 29.1 |
| | 204 | 3.1 | 322 | 1,182 | 117 | 150 | 26.7 |
| | 205 | 3.6 | 325 | 1,192 | 118 | 148 | 29.5 |
| | 206 | 3.5 | 331 | 1,215 | 118 | 149 | 23.8 |
| | 207 | 8.2 | 336 | 1,230 | 122 | 144 | 17.5 |
| | 208 | 10.5 | 348 | 1,275 | 125 | 139 | 15.6 |
| Comparative Example | 251 | Cracks of the material ware occurredinrolling | | | | | |
| | 252 | 13.3 | 262 | 962 | 129 | 132 | 28.2 |
| | 253 | 8.2 | 265 | 970 | 129 | 132 | 27.6 |
| | 254 | 14.1 | 221 | 810 | 108 | 113 | 40.3 |
| | 255 | 13.5 | 223 | 822 | 126 | 134 | 38.5 |
| | 256 | 17.7 | 226 | 825 | 126 | 131 | 37.7 |
| | 257 | 14.2 | 228 | 831 | 126 | 134 | 39.2 |

As shown in Table 2, Examples 201 to 208 that satisfied the definitions in the present invention, each exhibited excellent characteristics. It was found that due to the effect of adding optionally adding elements, the desired orientation densities of the {110}<001> orientation and the {110}<112> orientation were slightly became higher, the maximum value L of the major axis of the grains of the matrix became smaller, and the yield strength YS was enhanced.

FIG. 4 shows a photograph of the texture of Example 204. This is a grain boundary map obtained by the FE-SEM/EBSD measurement, and the maximum value (L) of the major axis of the grains of the matrix was 3.1 μm.

On the other hand, in Comparative Examples, since the alloy compositions did not satisfy the conditions defined in the present invention, at least one of the orientation density of the {110}<001> orientation, the orientation density of the {110}<112> orientation, and the maximum value L of the major axis of the grains of the matrix did not satisfy the conditions defined in the present invention. Therefore, Comparative Examples were poor in at least one characteristics among Vickers hardness Hv, yield strength YS, Young's modulus in the direction parallel to the rolled direction E(RD), and Young's modulus in the direction perpendicular to the rolled direction E(TD).

In Comparative Example 251, since the optionally adding element was too large, the material exhibited poor manufacturability. In Comparative Example 252 produced by the production method C, the maximum value L of the major axis of the grains of the matrix was too large. Further, in Comparative Example 253 produced by the production method D, the orientation densities of the {110}<001> orientation and the {110}<112> orientation were too small. In these Comparative Examples 252 and 253, the yield strength YS was too low in both materials, and Young's modulus in the direction parallel to the rolled direction E(RD) was too high, while Young's modulus in the direction perpendicular to the rolled direction E(TD) was too low. Thus, the materials could not be controlled to have desired Young's modulus values, and were poor.

As other Comparative Examples, in Comparative Examples 254, 255, 256, and 257 produced by the production methods E, F, G, and H, in each case, the orientation density of the {110}<112> orientation was too low, and the maximum value L of the major axis of the grains of the matrix was too large, the yield strength YS was too low, and Young's modulus in the direction perpendicular to the rolled direction E(TD) was too low. Thus, the materials could not be controlled to have desired Young's modulus values, and each were poor. Among these, in Comparative Examples 254 and 257, the orientation density of the {110}<001> orientation was too small, and in Comparative Example 254, the orientation density of the {001}<100> orientation was too large.

Further, Comparative Examples 252 to 257 each had also a poor Vickers hardness Hv.

FIG. 5 shows a photograph of the texture of Comparative Example 256. This is a grain boundary map obtained by the FE-SEM/EBSD measurement, and the maximum value (L) of the major axis of the grains of the matrix was 17.7 μm.

Further, as a still another Comparative Example, a sample material of a copper alloy sheet material was obtained by producing the material by production method N described below.

(Production Method N) Production Method Corresponding to Example 1 Described in JP-A-2009-074125

A copper-based alloy having a composition of Cu-2.3Ni-0.45Si-0.13Mg (each mass %) produced by melting and casting was subjected to semi-continuous casting using a copper mold, to cast into a rectangular cross-section ingot having a cross-section size of 180 mm×450 mm and a length of 4,000 mm. Then, the ingot was heated to 900° C. and was subjected to hot-rolling at a one-pass average working ratio of 22%, to obtain a thickness of 12 mm. Then, cooling was initiated from 650° C., and the sheet was water-cooled at a cooling speed of about 100° C./min. The two surfaces of the resultant sheet were subjected to face-milling by 0.5 mm each, and then the sheet was subjected to cold-rolling to obtain a thickness of 2.5 mm (working ratio=77.3%) and to an aging treatment for 3 hours at a temperature of 500° C. in an Ar atmosphere. The resultant sheet was further subjected to cold-rolling to obtain a thickness of 0.3 mm (working ratio=88.0%), and was subjected to annealing for 1 minute at 500° C. in an Ar atmosphere, finish cold-rolling to obtain a thickness of 0.15 mm (working ratio=50.0%), and stress-relief annealing for 1 minute at 450° C. in an Ar atmosphere.

With respect to a specimen of this Comparative Example, characteristics were measured and evaluated in the same manner as described above. The results are presented together in Table 3.

TABLE 3

| | | {110} <001> orientation density | {110} <112> orientation density | {001} <100> orientation density |
|---|---|---|---|---|
| Comparative Example | 258 | 3 | 18 | 0 |

| | | Maximum value L of major axis of grains μm | Hardness Hv | Yield strength YS MPa | Young's modulus E (RD) GPa | Young's modulus E (TD) GPa | Electrical conductivity EC % IACS |
|---|---|---|---|---|---|---|---|
| Comparative Example | 258 | 13.7 | 260 | 780 | 131 | 145 | 47.2 |

Comparative Example 258 produced by the production method N did not satisfy the ranges of the present invention, in relation to the orientation density of the {110}<001> orientation and the major axis (the crystal size) of the grains of the matrix, and exhibited poor Vickers hardness [Hv], poor Young's modulus in the direction parallel to the rolled direction [E(RD)], and poor yield strength [YS].

From the Examples described above, effectiveness of the present invention was proved.

The invention claimed is:

1. A copper alloy sheet material, having an alloy composition comprising at least one of Ni and Co in an amount of 1.80 to 8.00 mass % in total, Si in an amount of 0.40 to 2.00 mass %, and optionally at least one element selected from the group consisting of Sn, Zn, Ag, Mn, P, Mg, Cr, Zr, Fe, and Ti in an amount of 0.000 to 2.000 mass % in total, with the balance being copper and unavoidable impurities, wherein a major axis of grains in a matrix is 12 μm or less; and wherein an orientation density of a {110}<001> orientation is 4 or more, and an orientation density of a {110}<112> orientation is 10 or more.

2. The copper alloy sheet material as claimed in claim 1, which contains the at least one element selected from the group consisting of Sn, Zn, Ag, Mn, P, Mg, Cr, Zr, Fe, and Ti in an amount of 0.005 to 2.000 mass % in total.

3. The copper alloy sheet material as claimed in claim 1, wherein a Vickers hardness is 280 or more.

4. A connector formed to contain the copper alloy sheet material as claimed in claim 1.

* * * * *